United States Patent [19]

Bauer et al.

[11] Patent Number: 4,694,915

[45] Date of Patent: Sep. 22, 1987

[54] SLOTTED WALL MILLING CUTTER

[75] Inventors: Karlheinz Bauer, Schrobenhausen; Maximilian Arzberger, Igenhausen, both of Fed. Rep. of Germany

[73] Assignee: Karl Bauer Spezialtiefbau GmbH & Co KG, Schrobenhausen, Fed. Rep. of Germany

[21] Appl. No.: 849,449

[22] Filed: Jun. 12, 1986

[51] Int. Cl.[4] ..... E21B 4/16

[52] U.S. Cl. ..... 175/91; 175/96; 175/104

[58] Field of Search ..... 175/96, 101, 102, 104, 175/113, 189, 412, 91

[56] References Cited

U.S. PATENT DOCUMENTS

| | | | |
|---|---|---|---|
| 1,574,040 | 2/1926 | Lasher | 175/102 |
| 3,190,376 | 6/1965 | Christensen | 175/102 |
| 3,710,878 | 1/1973 | Endo et al. | 175/91 |
| 3,894,587 | 7/1975 | Sourice | 175/96 |

FOREIGN PATENT DOCUMENTS

| | | | |
|---|---|---|---|
| 1142815 | 1/1963 | Fed. Rep. of Germany | 175/96 |
| 0109907 | 5/1984 | France | 175/320 |

*Primary Examiner*—James A. Leppink
*Assistant Examiner*—Terry Lee Melius
*Attorney, Agent, or Firm*—Fleit, Jacobson, Cohn & Price

[57] ABSTRACT

A slotted wall milling cutter for producing a slotted wall in the ground has a drive motor fixed to the cutter frame and a gear means positioned between the drive motor and two cutting wheel gears and which is partly arranged in recesses of a bearing bracket. The cutting wheel gear is constructed as a multistage planetary gear. A particularly high torque is made available on the cutting wheels with this arrangement. In addition, the cutting wheels can be constructed with a very high effective cutting width compared with the total slot width.

13 Claims, 7 Drawing Figures

SLOTTED WALL MILLING CUTTER

BACKGROUND OF THE INVENTION

The present invention relates to a slotted wall milling cutter for producing a slotted wall in the ground according to the preamble of the main claim.

Slotted wall milling cutters are known in which a hydraulic motor and gear units are arranged within the hub of the cutting wheels for driving the latter. Oil is supplied by means of bores in the support frame for the cutting wheels. It is disadvantageous in such slotted wall milling cutters that within the wheels it is necessary to house both the drive motor and the gear units, so that very little space is available which could be used for producing a high torque. It is also disadvantageous with the prior art means that in the case of a gear change a certain quantity of hydraulic oil always flows out of the lines and is lost.

SUMMARY OF THE INVENTION

The problem of the invention is to provide a slotted wall milling cutter of the aforementioned type, in which in the case of a given drive motor power on the cutting wheels a particularly high torque is available and in which simultaneously the cutting wheels have a highly effective cutting width relative to the total slot width.

According to the invention this problem is solved in that the drive motor is fixed to the milling cutter frame, that the gear means connecting the drive motor and the cutting wheel gear is at least partly arranged in recesses of the bearing bracket and that the cutting wheel gear is constructed as a multistage planetary gear.

As a result of the inventive arrangement of the drive motor on the milling cutter frame, it is possible that the space available in the cutting wheels can be used exclusively for producing a very high torque. This arrangement also makes it possible for the weight of the drive motor to contribute to producing the high contact pressure necessary for advancing the slotted wall milling cutter in hard ground. Thus, particularly in the case of concrete or bedrock, it is on the one hand possible to obtain the high torque per cutting tooth and on the other a high weight for the contact pressure. Thus, an adequate number of cutting teeth can be provided, which is necessary so that the cut material has a corresponding small particle size and is therefore suitable for suction.

According to the invention the gear means connecting the drive motor to the milling cutter gears is located at least partly in recesses of the bearing bracket, so that it is possible to transfer the torque from the drive motor to the cutting wheel gear in an extremely space-saving manner. The initially low torque supplied by the gear means is converted into a very high torque in the milling wheel gears by reducing the speed (to approximately 20 revolutions per minute) and simultaneously increasing the effective lever arm. According to the invention this is achieved in that the cutting wheel gear is constructed as a multistage planetary gear.

The drive motor can be constructed as an electric or hydraulic motor and in both cases the milling cutter drums can be changed without it being necessary to open the hydraulic lines.

The gear means arranged between the drive motor and the milling cutter gears can be constructed as bevel gearing with a transmission shaft. The only constructional measure necessary is that a bore is made in the bearing bracket, which can also have a smaller diameter, because the drive shaft can also have relatively small dimensions through the input torque having to be transferred by the drive motor being small. As an alternative to the bevel gearingk it is possible to transfer the input torque via a chain drive with a chain and two sprocket wheels from the drive motor to the milling cutter gear. Both in the case of torque transmission by bevel gearing and in the case of torque transmission by a chain drive, it is advantageous for the gear to be vertically guided between the drive motor and the rotation axis of the cutting wheels, because on the one hand the motor weight can be fully used for the contact pressure and on the other the torque is supplied over the shortest distance to the milling cutter gear.

In the embodiments of the slotted wall milling cutter with bevel gearing or a chain drive, it is very clear that the vertically standing, planar portion of the bearing bracket can be made particularly thin, so that the effective width of the cutting wheels can be very large compared with the total slot width. Advantageously the bearing bracket is also constructed in such a way that its lower edge terminates at a distance above the lower edge of the cutting wheels.

According to a further advantageous development of the slotted wall milling cutter, a separate drive motor and gear means is provided for each cutting wheel gear. It is also possible to provide several drive motors and several gear means for each cutting wheel gear, so that the total power of the slotted wall milling cutter can be increased in accordance with the particular requirements.

In addition, the portions of the gear means extending beyond the bearing bracket can be enclosed in a casing so that on the one hand the gear is protected from effects from the outside and on the other hand operators cannot come into contact with rotating parts.

The gear means arranged within the bearing bracket can advantageously be arranged in such a way that within the bracket plane they are substantially V-shaped and at right angles to said plane substantially parallel and spaced from one another. Thus, in a very appropriate and advantageous manner each milling cutter gear can be individually supplied with the torque necessary for drive purposes. Each planetary gear of the two cutting wheels positioned parallel to the bearing bracket is separately driven, but both in the case of the V-shaped arrangement of the gear means and in the case of the vertical arrangement of a single bevel gearing or chain drive to jointly drive the two cutting wheels of a cutting wheel set. In the case of a vertically arranged bevel gearing or chain drive, the two cutting wheels of a cutting wheel set are driven by means of a single shaft, the wheels rotating equidirectionally.

According to a further advantageous development, the slotted wall milling cutter has a geared coupling, which is positioned between the drive motor and the transmission shaft of a bevel gearing, so as to permit rapid, problem-free changing of the cutter drums or rollers.

Through the inventive arrangement of the drive motor in the milling cutter frame, it is also possible to use commercially available hydraulic or electric motors of appropriate size, because there are no limitations with regards to the installation space.

BRIEF DESCRIPTION OF THE DRAWINGS

The invention is described in greater detail hereinafter relative to three non-limitative embodiments and the attached drawings, wherein show.

DETAILED DESCRIPTION OF THE PREFERRED EMBODIMENTS

Figure 1:
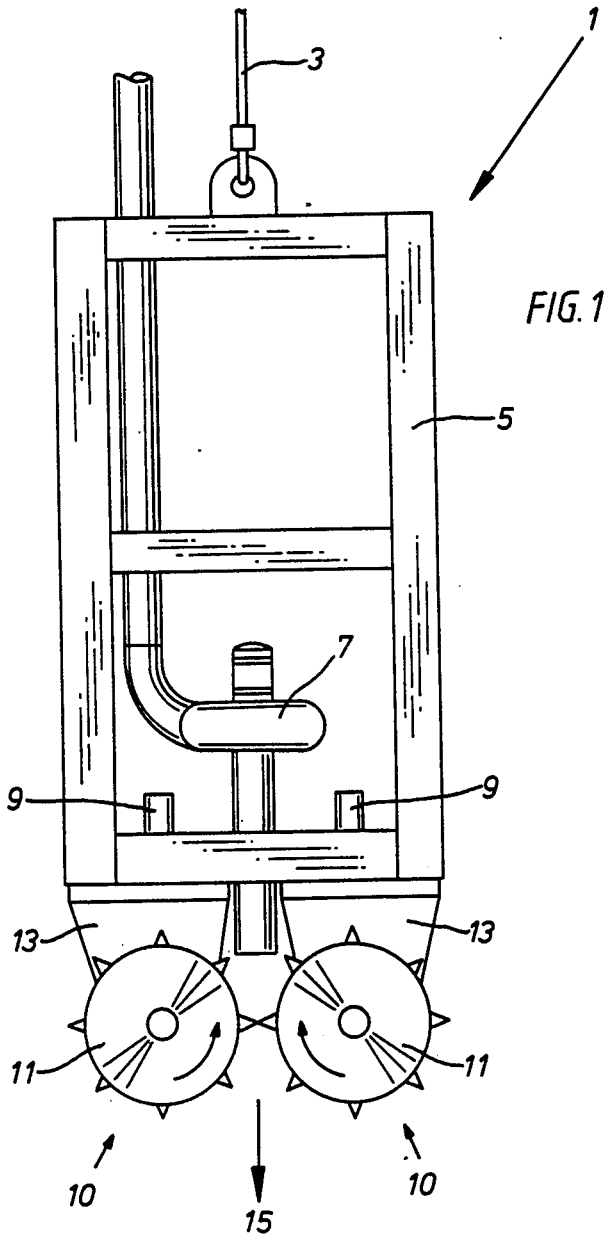
FIG. 1 The basic construction of a slotted wall milling cutter in front view.

According to FIG. 1 the slotted wall milling cutter 1 essentially comprises a supporting frame 5 held by a supporting cable 3 and to which is fixed a suction means with pump 7. According to the invention, the drive motors 9 for the cutting wheels 11 are fixed to the cutter frame 5. Two bearing brackets 13, in which the cutting wheels 11 are received in rotary manner are also fixed to the frame 5. In use, the slotted wall milling cutter 1 is advanced in the direction of arrow 15. In the case of the represented slotted wall milling cutter 1, in the represented front view only the front cutting wheels 11 of the two successively arranged cutting wheels of the two cutting wheel sets 10 can be seen. The rear cutting wheels run parallel to the bearing bracket 13 in the same way as the front cutting wheels 11.

When in operation, the two cutting wheel sets 10 rotate in opposite directions in the manner indicated by the two arrows in FIG. 1 and thus supply the cut material to the suction means with pump 7.

Figure 2:
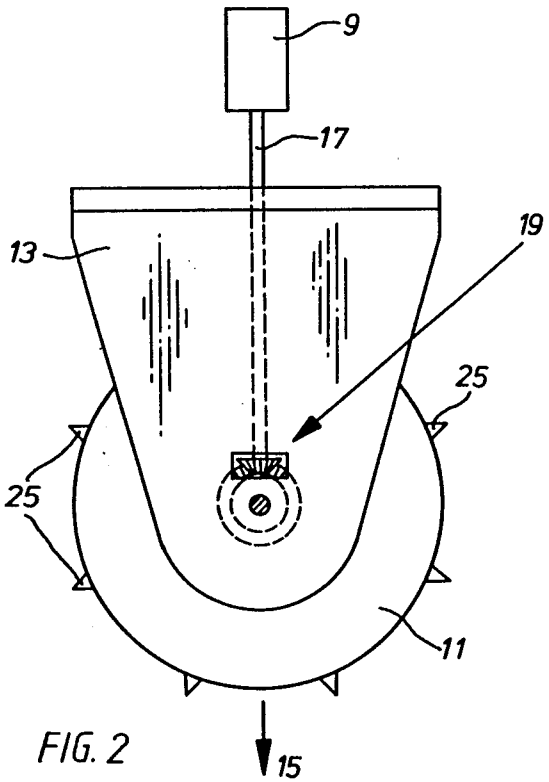
FIG. 2 Diagrammatically the inventive arrangement of the drive units for a cutting wheel with bevel gearing in front view.

FIG. 2 diagrammatically shows the inventive arrangement of the drive units for the cutting wheel 11. A shaft 17 of bevel gearing 19 leads vertically downwards from the drive motor 9 fixed in the cutter frame. From bevel gearing 19, the torque is e.g. transmitted to a sun gear shaft 21 of two planetary gears, in each case arranged within one of the cutting wheels 11. Arrow 15 again indicates the advance direction in which the slotted wall milling cutter is advanced in use.

Figure 3:
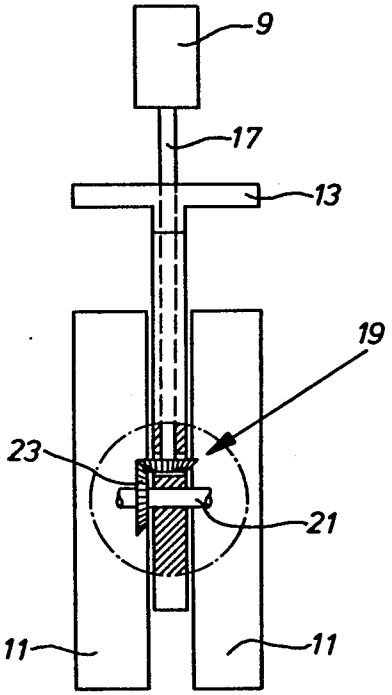
FIG. 3 The inventive arrangement of FIG. 2 in side view, the two cutting wheels of a cutting wheel set being shown.

FIG. 3 is a side view of the inventive arrangement of FIG. 2. It is clearly possible to see the symmetrical arrangement of the two cutting wheels 11 with respect to the bearing bracket 13. Advantageously, only one bevel gear 23 has to be placed on the sun gear shaft 21, in order to transfer the driving torque to the shaft 21 and consequently into the planetary gear of the cutting wheels.

FIGS. 2 and 3 show that only one bore has to be provided for passing shaft 17 through bearing bracket 13, so that the torque transmission can take place over a relatively short distance and the shaft 17 is protected by the bearing bracket 13. Moreover the large internal diameter of the cutting wheels 11 can be used to obtain a high torque, which is then available on teeth 25 of the cutting wheels 11.

Figure 5:
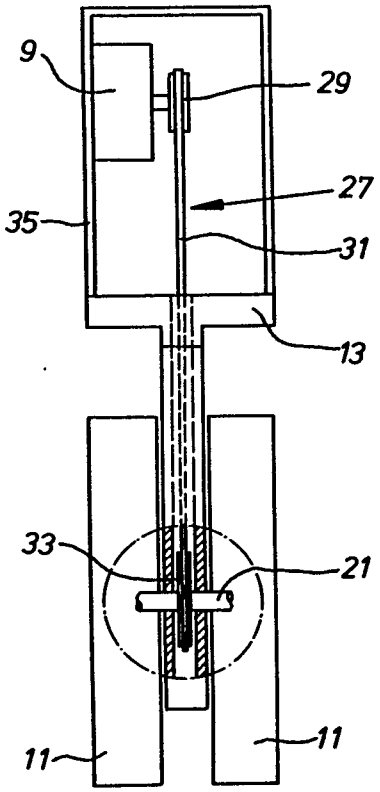
FIG. 5 The inventive arrangement of FIG. 4 in side view with the two cutting wheels of a cutting wheel set.
Figure 4:
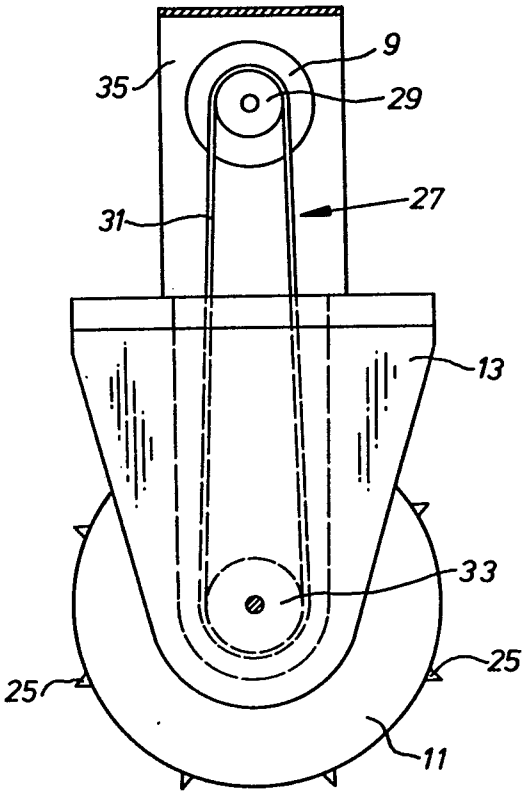
FIG. 4 Diagrammatically the inventive arrangement of the drive units with an enclosed chain drive and a cutting wheel in front view.

The inventive arrangement of the drive units shown in front and side view in FIGS. 4 and 5 constructionally essentially correspond to the arrangement of FIGS. 2 and 3. However, differing therefrom, the bevel gearing constituting the torque transmission means between drive motor 9 and sun gear shaft 21 of the planetary gear is replaced by a chain drive 27. The latter essentially comprises a sprocket wheel 29 fixed to the drive motor, a chain 31 and a sprocket wheel 33 arranged on the sun gear shaft. Chain 31 connects drive motor 9 and sun gear shaft 21 in the vertical direction and is on the one hand protected by the fact that it passes in a recess in bearing bracket 13 and on the other hand by the fact that it is enclosed in the zone between drive motor 9 and bearing bracket 13, i.e. it is protected with a casing 35 in said zone. With this straight, direct transmission of the driving torque from motor 9 to sun gear shaft 21 and the linked planetary gear of the cutting wheels, it is possible to use a rapidly moving chain 31 with an initially low driving torque, the torque being increased in the planetary gears by reducing the speed and simultaneously a high torque is produced by the large lever arms available in the cutting wheels. The geometrical conditions in the cutting wheels 11 are favourable, because the drive motor 9 is arranged in the cutter frame and not in the vicinity of the cutting wheels.

Figure 7:
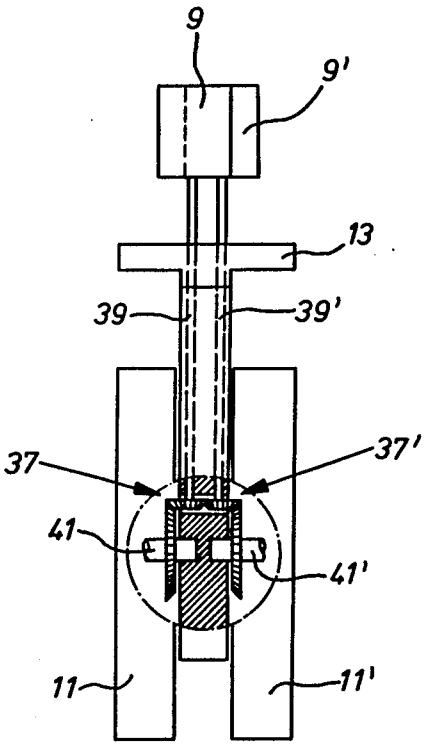
FIG. 7 The inventive arrangement of FIG. 6 with two cutting wheels of a cutting wheel set in side view.
Figure 6:
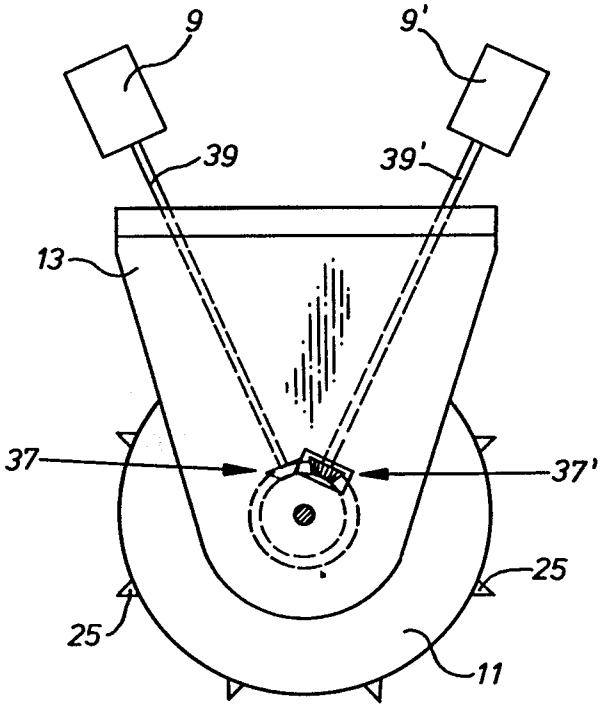
FIG. 6 Diagrammatically the inventive arrangement of the drive units with two bevel gears and a cutting wheel in front view.

The construction of the drive units according to the invention shown in FIGS. 6 and 7 essentially corresponds to that shown in FIGS. 2 and 3. However, differing from the latter, each cutting wheel 11, 11′ is separately driven by a drive motor 9, 9′ across bevel gearing 37, 37′ and a sun gear shaft 41, 41′ of a planetary gear. FIG. 6 shows that the drive shaft 39, 39′ of bevel gearing 37, 37′, viewed from the front, are arranged in V-shaped manner between drive motors 9, 9′ and the driven pinions of bevel gearing 37, 37′. Considered laterally, the two shafts 39, 39′ are substantially parallel and spaced from the centre plane of bearing bracket 13. Due to the simpler representation in FIG. 7, drive motor 9′, shaft 39′, bevel gearing 37′ and sun gear shaft 41′ are shown in the inwardly rotated position.

The shafts of the bevel gearing shown in FIGS. 2/3 and 6/7 can be enclosed in their section between drive motors 9, 9′ and bearing bracket 13.

What is claimed is:

1. A slotted wall milling cutter for producing a slotted wall in the ground, said slotted wall milling cutter comprising:

a cutter frame, a bearing bracket fixed to said cutter frame, two roller-like cutting wheels rotatably mounted on said bearing bracket, one of said two roller-like cutting wheels being located on each side of said bearing bracket, at least one drive motor for rotating said two roller-like cutting wheels, a cutting wheel gear arranged in said two roller-like cutting wheels to drive said two roller-like cutting wheels, and gear means including transmission means for interconnecting and transmitting a driving force between said at least one drive motor and said cutting wheel gear, said gear means being mounted within said bracket means to protect said gear means while the slotted milling cutter produces a slotted wall in the ground.

2. A slotted wall milling cutter according to claim 1, wherein the drive motor is constructed as an electric motor.

3. A slotted wall milling cutter according to claim 1, wherein the drive motor is constructed as a hydraulic motor.

4. A slotted wall milling cutter according to claim 1, wherein the gear means is constructed as bevel gearing with a transmission shaft.

5. A slotted wall milling cutter according to claim 1, wherein the gear means is constructed as a chain drive with a transmission chain and two sprocket wheels.

6. A slotted wall milling cutter according to claim 1, wherein a separate drive motor and gear means is provided for each cutting wheel gear.

7. A slotted wall milling cutter according to claim 1, wherein each gear means is enclosed within a casing.

8. A slotted wall milling cutter according to claim 1, wherein the gear means are arranged within the bearing bracket in the bearing bracket plane in substantially V-shaped manner and substantially parallel and spaced to one another at right angles to the bearing bracket plane.

9. A slotted wall milling cutter according to claim 1, wherein the transmission shaft is guided vertically between the drive motor and the rotation axis of the cutting wheels.

10. A slotted wall milling cutter according to claim 1, wherein the transmission chain is guided vertically between the drive motor and the rotation axis of the cutting wheels.

11. A slotted wall milling cutter according to claim 1, wherein both cutting wheel gears of the cutting wheels are coupled together by a single shaft.

12. A slotted wall milling cutter according to claim 1, wherein a geared coupling is provided between the drive motor and the transmission shaft.

13. A slotted wall milling cutter according to claim 1, wherein the lower edge of the bearing bracket terminates in spaced manner above the lower edge of the milling cutters.

* * * * *